US006898878B2

(12) United States Patent
Yoshida et al.

(10) Patent No.: US 6,898,878 B2
(45) Date of Patent: May 31, 2005

(54) PIPING ARRANGEMENT FOR SWING TYPE HYDRAULIC EXCAVATORS

(75) Inventors: Kouichi Yoshida, Komatsu (JP); Kiyoshi Sugiyama, Kanazawa (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/798,427

(22) Filed: Mar. 12, 2004

(65) Prior Publication Data

US 2004/0187366 A1 Sep. 30, 2004

(30) Foreign Application Priority Data

Mar. 24, 2003 (JP) ..... 2003-079351

(51) Int. Cl.[7] ..... E02F 9/00
(52) U.S. Cl. ..... 37/466
(58) Field of Search ..... 37/411–417, 443–445, 37/466

(56) References Cited

FOREIGN PATENT DOCUMENTS

| | | |
|---|---|---|
| JP | 10 114967 | 5/1998 |
| JP | 11-103083 | 1/1999 |
| JP | 2000-096610 | 4/2000 |
| JP | 2000-230241 | 8/2000 |
| JP | 2000-230242 | 8/2000 |
| JP | 2000-230251 | 8/2000 |
| JP | 2001-040701 | 2/2001 |
| JP | 2001-311181 | 11/2001 |
| JP | 2002-348909 | 12/2002 |

*Primary Examiner*—Christopher J. Novosad
(74) *Attorney, Agent, or Firm*—Varndell & Varndell, PLLC

(57) ABSTRACT

An improvement in a piping arrangement for swing type hydraulic excavators achieved. Piping is provided on a cylinder for an implement from a side of the swivel frame through the swing bracket, the swing bracket is formed on a side thereof with a piping hole, which extends outside from an interior thereof, and piping for that cylinder for an implement, which is disposed in the vicinity of the swing bracket, is performed from the interior of the swing bracket through the piping hole.

3 Claims, 7 Drawing Sheets

PIPING ARRANGEMENT FOR SWING TYPE HYDRAULIC EXCAVATORS

BACKGROUND OF THE INVENTION

1. Field of the Invention

The present invention relates to a piping arrangement for swing type hydraulic excavators.

2. Description of the Related Art

Conventionally, employed frequently for small-sized hydraulic excavators used for urban type public works are swing type hydraulic excavators comprising an implement having a boom, an arm, a bucket, and the like and mounted on a forward end of an upper swivel body through a swing bracket, which is mounted to be able to transversely swing (referred below to as swing), to be able to vertically swing, and making combined use of swiveling of the upper swivel body and swing of the implement to make the implement offset from a lower swivel body to enable sewer excavation. Further, an implement comprises a boom cylinder, an arm cylinder, a bucket cylinder, and many actuators such as hydraulic cylinders for various attachments, or the like, and pipes for feeding of oil thereto are large in number.

Accordingly, in piping design to extend these many pipes from respective main control valves on a swivel frame through a boom to arrange them on respective actuators, there is needed a careful consideration taking account of maintenance, beautiful view, or the like, not to mention breakage of the pipes, and prevention of a trouble with oil leakage. In particular, it is one of very important things to arrange lengths of hose around the swing bracket; which needs two operations, that is, vertical swing and transverse swing of the implement, while ensuring reliability on the lengths of hose.

Conventionally, means for arranging a group of pipes around a swing bracket in a swing type hydraulic excavator is disclosed in, for example, pages 2 to 4 and FIGS. 5 and 6 in Patent Document 1 (JP-A-2000-96610) to be known. FIG. 6 in the Patent Document is a perspective view showing a piping for a boom cylinder in the swing type hydraulic excavator described in Patent Document 1.

As shown in FIG. 6, a swing bracket 109 swingable about a vertical shaft is pivotally mounted on a front end of a swivel slide 104 (corresponding to a swivel frame in the invention, and referred below to as a swivel frame 104), and a root portion 119 of a boom structure 113 (referred below to as a boom 113) is mounted on the swing bracket 109 through a transverse pivot 120 to be movable vertically. The swing bracket 109 is pivotally mounted by the transverse pivot 120 in a state, in which the swing bracket is interposed by the root portion 119 of the boom 113, to define in front of the transverse pivot 120 a space 122 surrounded by the root portion 119. A major part of a hose group 123 for a working oil passing through an interior of the swing bracket 109 passes through the space 122 upward from below and reaches an upper surface of the boom 113.

As shown in FIG. 6, lengths of hydraulic hose 123A for a boom cylinder 116 extend from the swivel frame 104 without passage through the interior of the swing bracket 109 to directly pass by a side of the swing bracket 109 via a holder 123B to be connected to respective piping ports of the boom cylinder 116.

Also, for example, Patent Document 2 (JP-A-2000-230251, pages 3 to 4, FIGS. 2 and 5) describes a construction of an implement associated with piping of lengths of hydraulic hose for driving of the implement around a swing bracket of a conventional swing type hydraulic excavator. FIG. 7 is a side view showing a construction of an implement around a swing bracket and piping of lengths of hydraulic hose for an implement described in Patent Document 2. In FIG. 7, a swivel working vehicle comprises a boom 206 mounted to a swivel body 202, which is constructed to be able to swivel, through a boom bracket 212 (corresponding to a swing bracket in the invention, and referred below to as a swing bracket 212) to be able to swing vertically, and an implement having an arm (not shown) mounted on the boom 206 to be able to swing vertically. A hose guide 214 is provided fixedly on an upper end of a swing pin 213 extending vertically through the swivel body 202 and the swing bracket 212 and connecting the both together to enable the same to swing left and right. The hose guide 214 guides lengths of hydraulic hose for the implement, extended from the swivel body 202, and a major part of the lengths of hydraulic hose is arranged inside the boom 206.

Further, among the lengths of hydraulic hose, lengths of hose 223 for the boom cylinder are extended from a swivel frame upper plate 202*a* to pass through an interior of the swing bracket 212 to be connected to a boom cylinder 211 as shown in FIG. 7. That is, the lengths of hose 223 for the boom cylinder extend above the swivel frame upper plate 202*a* and lowers via a downwardly opening guide hole 212*c* of a boom support 206*a* on the swing bracket 212. The lengths of hose 223 extend below a cylinder support 212*b* of the boom cylinder 211 and goes around the cylinder support 212*b* to extend from an interior of the swing bracket 212 to be connected to respective piping ports of the boom cylinder 211 disposed above.

However, the conventional technique described above involves the following problems. In the conventional technique described in Patent Document 1, lengths of hydraulic hose 123A for the boom cylinder and extending from the swivel frame 104 pass by the side of the swing bracket 109 to be arranged. Hereupon, in order to ensure a space for expansion of the lengths of hydraulic hose caused when the boom 113 swings, there is a need for a spacing between the swivel frame 104 and the swing bracket 109, so that the whole machine is made large in size. Also, since the lengths of hydraulic hose 123A are exposed to outside at many portions thereof, there is increased a fear of damage caused by fly stone and impinging matters. Further, since the lengths of hydraulic hose 123A cover the side of the swing bracket 109, a beautiful sight around the swing bracket 109 is injured.

Also, the conventional technique described in Patent Document 2 involves the following problems. The piping arrangement of the lengths of hose 223 for the boom cylinder, which meander inside the swing bracket 212 to reach the boom cylinder 211, requires an exclusive piping passage inside the swing bracket 212, and therefore the swing bracket 212 is made complicate in structure, large in size, and expensive. Also, the lengths of hose 223 for the boom cylinder project forwardly of a forward most portion of the swing bracket 212, and so there is a fear of generation of damage caused by fly stone, impinging matters, and the like.

SUMMARY OF THE INVENTION

The invention has been thought of in view of the above problems, and has its object to provide a piping arrangement for swing type hydraulic excavators, which is able to achieve miniaturization of a machine, prevention of damage from outside, and an improvement in beautiful view.

In order to attain the above object, the invention provides a piping arrangement for swing type hydraulic excavators, wherein a swing bracket is provided on a forward end of a swivel frame to be able to swing horizontally, the swing bracket mounts thereto a base end of a vertically swingable boom and one end of a boom cylinder, which drivingly swings the boom, respectively, by means of horizontal support pins, and mounts thereto one end of a swing cylinder, which drivingly swings the swing bracket, by means of a vertical support pin, piping is provided on a cylinder for an implement from a side of the swivel frame through the swing bracket, the swing bracket is formed on a side thereof with a piping hole, which extends outside from an interior thereof, and piping for that cylinder for an implement, which is disposed in the vicinity of the swing bracket, is performed from the interior of the swing bracket through the piping hole.

With such construction, the piping hole is provided on the side of the swing bracket to extend outside from an interior thereof. Among the piping group extending from the main control valves on the swivel frame through the interior of the swing bracket to be connected to cylinders for the implement, pipes for a cylinder for the implement, such as the boom cylinder, the swing cylinder, and the like, disposed in the vicinity of the swing bracket, are conducted outside from the interior of the swing bracket through the piping hole to be connected to respective piping ports of these cylinders.

Accordingly, pipes being connected to the cylinders for the implement disposed in the vicinity of the swing bracket can extend through the piping hole from the interior of the swing bracket without strain to be arranged while assuming a large bending curvature and being reduced in the number of bending locations. Also, since the provision of the piping hole enables the pipes to assume a large bending curvature and to be reduced in the number of bending locations, it is possible to reduce pressure loss in piping and to enhance the hydraulic drive efficiency. Besides, since there are no locations, in which excessive bending operations are performed, lengths of hose can be extended in life. Also, the lengths of hydraulic hose are exposed to outside at less portions thereof, and so there is involved little fear of damage caused by fly stone and impinging matters. Further, since any hose does not cover the side of the swing bracket, a beautiful sight around the swing bracket is very good.

Further, with the piping arrangement, the cylinder for the implement may be a boom cylinder. With such constitution, the pipes for the boom cylinder together with the piping group being connected to respective cylinders for the implement extend from the main control valves on the swivel frame to enter the interior of the swing bracket to reach the piping hole on the side, and separate from the piping group to be conducted outside through the piping hole to be connected to respective piping ports of the boom cylinder in the vicinity of the swing bracket. The piping hole is positioned in the vicinity of the boom cylinder support pin, which constitutes a center for swinging of the boom cylinder, whereby the pipes for the boom cylinder are substantially restrained by the piping hole. Thereby, the pipes for the boom cylinder will swing about the piping hole as substantially a center, so that the pipes for the boom cylinder perform bending motions with little expansion, sag, or the like. Also, since the pipes for the boom cylinder can be extended substantially linearly from the piping hole to be arranged, they can be reduced in length.

Further, with the piping arrangement, the cylinder for the implement may be a swing cylinder. With such constitution, the pipes for the swing cylinder together with the piping group being connected to respective cylinders for the implement extend from the main control valves on the swivel frame to enter the interior of the swing bracket to reach the piping hole on the side, and separate from the piping group to be conducted outside through the piping hole to be connected to respective piping ports of the swing cylinder in the vicinity of the swing bracket. Owing also to such arrangement, the same effect as that for the boom cylinder is produced.

DESCRIPTION OF THE PREFERRED EMBODIMENTS

Embodiments of the invention will be described in detail with reference to the drawings.

Figure 1:
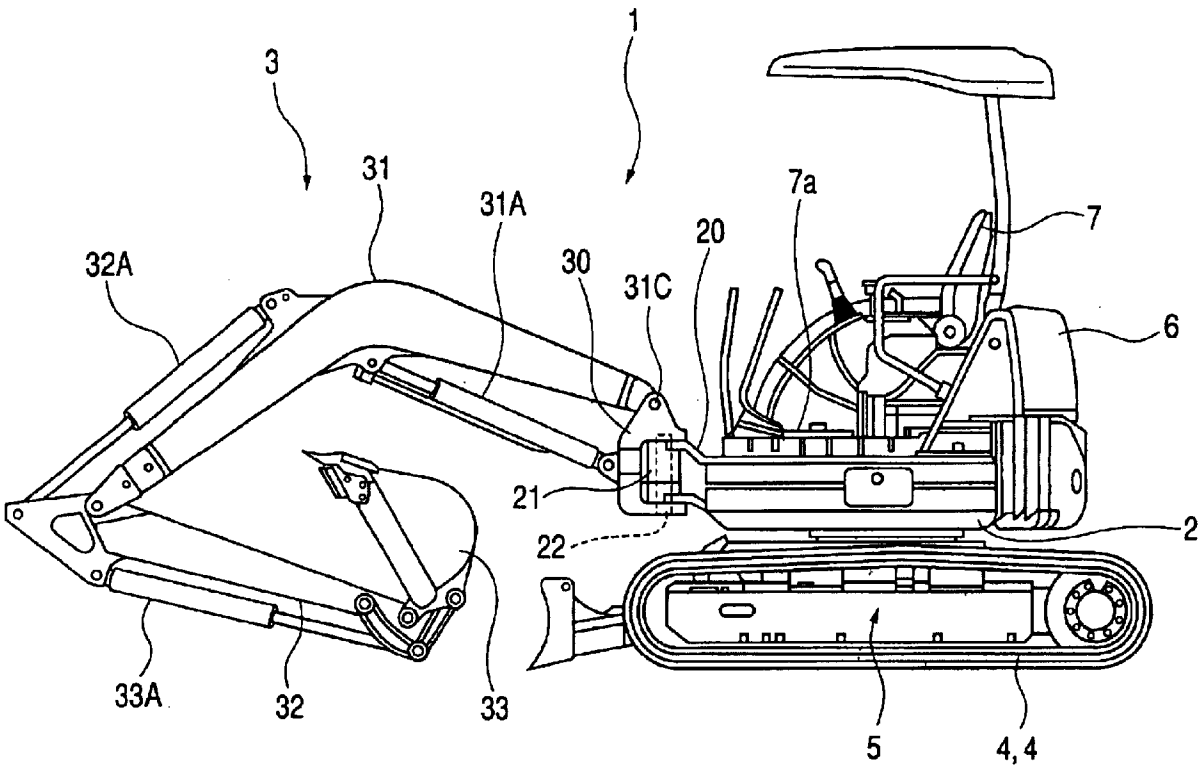
FIG. 1 is a side view showing a swing type hydraulic excavator according to the invention.

FIG. 1 is a side view showing a swing type hydraulic excavator according to the invention. The swing type hydraulic excavator 1 comprises a swivel frame 2 provided on a lower traveling body 5 having a pair of left and right crawler type traveling devices 4, 4 in a manner to be able to swivel. A driver seat 7 is arranged on the swivel frame 2 to extend from a left front to a center thereon, and an engine and a hydraulic pump, which are not shown, are arranged behind the driver seat 7 and covered by an armor cover 6. Arranged forwardly of the swivel frame 2 and downwardly of a floor plate 7*a* of the driver seat 7 is a valve unit (see FIG. 2) of main control valves 8 for driving of respective hydraulic actuators for an implement 3.

Figure 3:
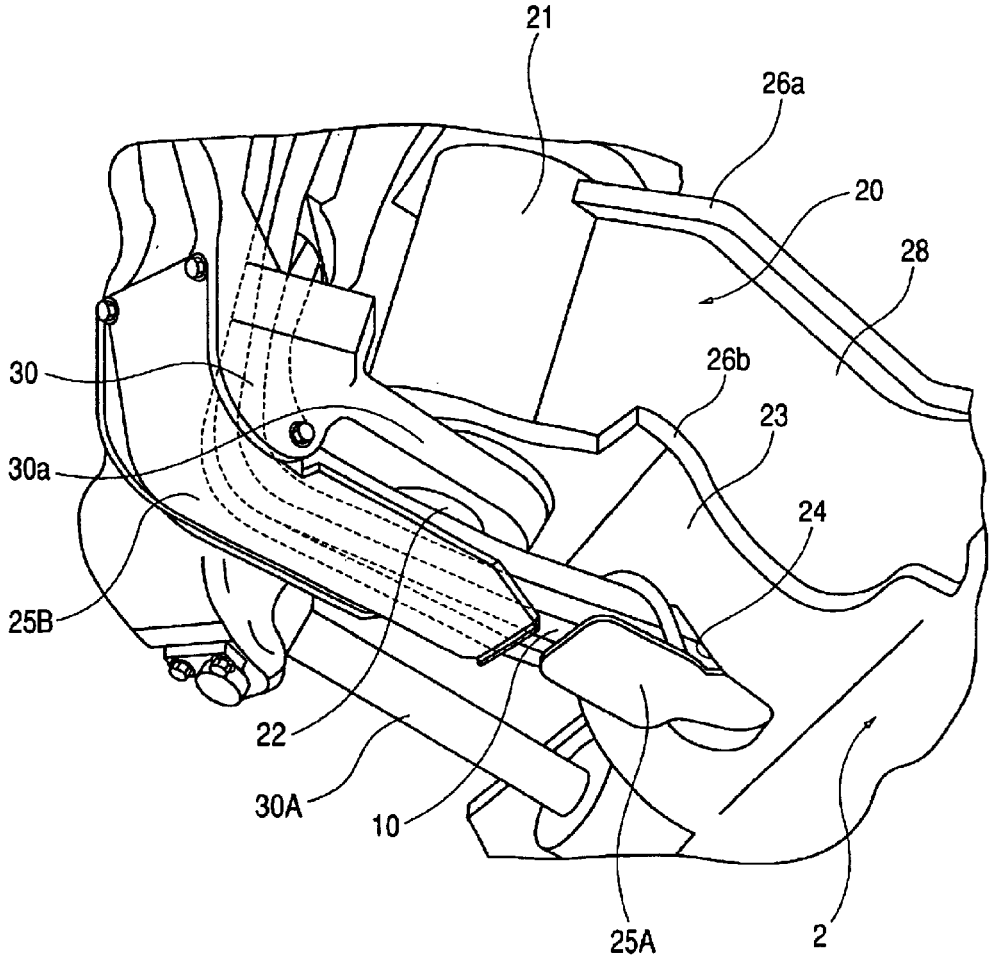
FIG. 3 is a perspective view, as viewed from forwardly downward, of the piping arrangement around the swing bracket according to the first embodiment.

A support bracket 20 having a swing pin support 21 is provided on a forward end of the swivel frame 2, and a swing bracket 30 is mounted on the swing pin support 21 through a vertically extending swing pin 22 to be able to swing transversely. The implement 3 is mounted on the swing bracket 30 through a transversely extending boom support pin 31C to be able to swing vertically. Also, as shown in FIG. 3, a swing cylinder 30A is mounted between a right side of the swing bracket 30 and the swivel frame 2. Extension and contraction of the swing cylinder 30A causes the swing bracket 30 to swing about the swing pin 22, so that the implement 3 pivotally mounted on the swing bracket 30 is swung.

A boom 31, an arm 32, and a bucket 33 on the implement 3 are connected together through respective horizontal pins in a manner to be able to swing. A boom cylinder 31A for drivingly swinging the boom 31 vertically is mounted between the boom 31 and the swing bracket 30, an arm cylinder 32A for drivingly swinging the arm 32 longitudinally is mounted between the arm 32 and the boom 31, and a bucket cylinder 33A for drivingly swinging the bucket 33 is mounted between the bucket 33 and the arm 32. Extending and contracting motions of these hydraulic cylinders 30A, 31A, 32A, 33A enable an excavating work such as sewer excavation or the like.

Figure 2:
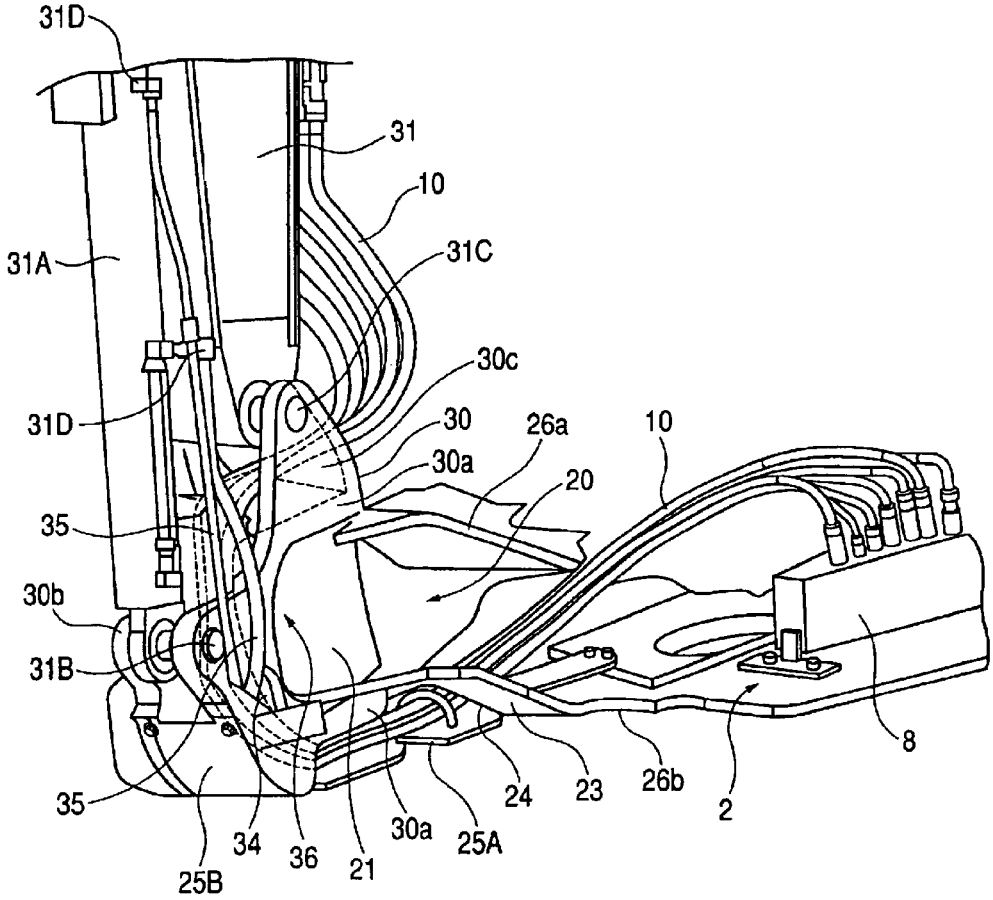
FIG. 2 is a perspective view, as viewed from forwardly upward, of a piping arrangement around a swing bracket according to a first embodiment of the invention.

With reference to FIGS. 2 and 3, the pipe arrangement in the swing type hydraulic excavator according to a first embodiment will be described below. The first embodiment represents an example of the piping arrangement of lengths of hose for the boom cylinder. As shown in FIG. 2, a piping group 10 for feeding of a working oil to respective actuators of the implement 3 such as the boom cylinder 31A, the arm cylinder 32A, the bucket cylinder 33A, attachments (not shown), and the like extends from the main control valves 8 mounted on the swivel frame 2 to pass through an interior of the swing bracket 30 to be arranged on an upper surface of the boom 31.

The swing bracket 30 comprises a connection 36 to assume a U-shape opened laterally as viewed in a side view. The connection is connected to the support bracket 20 by the swing pin 22 in a state, in which the swing pin support 21 of the support bracket 20 is interposed vertically between upper and lower connection members 30*a*, 30*a* of the connection 36. Further, a boom mount 30C, which assumes a U-shape opened upward as viewed in a front view, is provided on an upper surface of the upper connection member 30*a*, and the boom 31 is mounted on the boom mount 30C through a boom support pin 31C. Further, a boom cylinder mount 30*b*, which assumes a U-shape opened forward as viewed in a plan view, is provided on a forward portion of the swing bracket 30, and one end of the boom cylinder 31A is mounted to the boom cylinder mount 30*b* through a boom cylinder support pin 31B.

Provided on a forward end of the swivel frame 2 is a support bracket 20 having the swing pin support 21, to which the swing pin 22 serving as a swing pivot of the swing bracket 30 is mounted in a pivotal manner. The support bracket 20 comprises a pair of upper and lower support plates 26*a*, 26*b*, the swing pin support 21 secured between forward ends of the pair of support plates 26*a*, 26*b* and comprising a boss having a vertical axis, and sides 28 joining left and right sides of the pair of support plates 26*a*, 26*b* to each other. The swing pin support 21 is not divided but configured to be integral as shown in FIGS. 2 and 3. Also, the pair of upper and lower support plates 26*a*, 26*b* are provided with an upright portion 23 in order that an underside (that is, an underside of the swing pin support 21) of a tip end thereof be positioned a predetermined level above a base end thereof. The upright portion 23 is formed with a piping hole 24 shaped to permit therethrough insertion of the piping group 10 from the main control valves 8 without bending. An underside of the base end of the lower support plate 26*b* is set at the same level as a bottom surface of the swivel frame 2. With the above construction, a space for receiving therein the piping group 10 is formed between a bottom surface level of the swing pin 22 pivotally mounted on the swing pin support 21 and a bottom surface level of the swivel frame 2.

Figure 4:
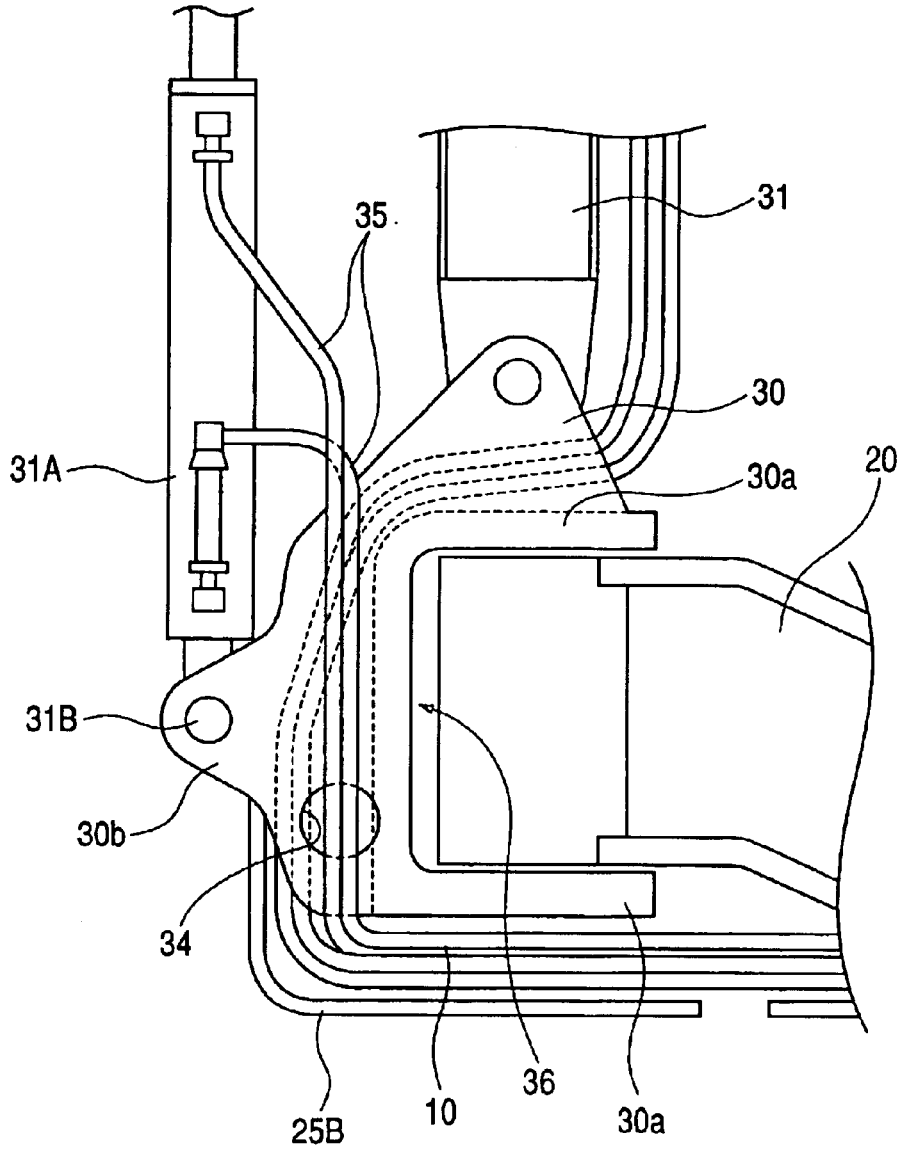
FIG. 4 is a side view showing the swing bracket according to the first embodiment.

As shown in FIG. 4, a piping hole 34 for the boom cylinder is provided on a side (here, a left side) of the boom cylinder mount 30*b* provided on a forward portion of the swing bracket 30 to be positioned between the connection 36 and the boom cylinder support pin 31B. Lengths of hose 35 for the boom cylinder among the piping group 10 passing through the piping hole 24 from the main control valves 8 to extend below the swing pin 22 to then reach the interior of the swing bracket 30 from between the connection 36 and the boom cylinder support pin 31B extend outside from the interior of the swing bracket 30 via the piping hole 34 for the boom cylinder to be connected to the boom cylinder 31A in a short distance.

Further; according to the embodiment, piping protective plates 25A, 25*b* are arranged below the piping group 10 in an area extending below the swing pin 22 from the piping hole 24 to the interior of the swing bracket 30. The piping protective plate 25A is in the form of a plate and has its one side extended through the piping hole 24 to be detachably clamped to the swivel frame 2 to protect the piping group 10 disposed at an exit portion from the piping hole 24 so that the piping group does not contact with a lower interference matter. Also, the piping protective plate 25B is in the form of a plate and has its one side detachably clamped to the swing bracket 30 to protect the piping group 10 extending below the swing pin 22 to be disposed at an inlet portion up to the interior of the swing bracket 30 so that the piping group 10 does not contact with a lower interference matter.

Subsequently, the operation of the piping arrangement according to the first embodiment will be described. With the above constitution according to the embodiment, the piping group 10 extends from the main control valves 8 mounted on the swivel frame 2 and passes extremely smoothly in a very large bending radius through the piping hole 24 provided on the upright portion 23 to extend below the swing pin 22.

Here, two lengths of hose 35 for the boom cylinder among the piping group 10 pass through the piping hole 34 for the boom cylinder, which is formed on the left side of the swing bracket 30, in the vicinity below the swing pin 22 to be conducted outside from the interior of the swing bracket 30 without being excessively bent in a small radius of curvature, and then is connected substantially linearly to respective piping ports 31D of the boom cylinder 31A in a shortest distance. The piping group 10 for the arm cylinder 32A, the bucket cylinder 33A, and attachments among except the lengths of hose 35 for the boom cylinder extend below the swing pin 22 to pass through the interior of the swing bracket 30 between the connection of the swing bracket 30 and the boom cylinder support pin 31B and are then arranged on the upper surface of the boom 31.

In this manner, owing to the constitution of the piping hole 34 for the boom cylinder, which is provided on the side of the swing bracket 30, the lengths of hose 35 for the boom cylinder, which reach the boom cylinder 31A disposed in the vicinity of the swing bracket 30, pass through the piping hole 34 for the boom cylinder from the interior of the swing bracket 30 without strain to be conducted outside. Thereby, the lengths of hose for the boom cylinder not only can assume a large radius of curvature but also can be made short in piping length. Also, for the above reason, pressure loss in the lengths of hose is reduced and so it is possible to enhance the hydraulic drive efficiency. Besides, since there are no locations, in which excessive bending operations are performed, it is possible to extend the life of the lengths of hose.

Since the piping hole 34 for the boom cylinder functions as a junction for piping and a location of constraint, it is possible to achieve shortening of piping length and optimization of piping. Also, since the lengths of hydraulic hose for the boom cylinder are exposed to outside at less portions thereof, there is involved little fear of damage caused by fly stone and impinging matters. Further, since the lengths of hose 35 for the boom cylinder are arranged to extend from the side of the swing bracket 30 to the boom cylinder 31A, they do not project from a forward most portion of the swing bracket 30, and so there is reduced generation of damage and trouble caused by fly stone, impinging matters, and the like from forward. Besides, since the lengths of hose 35 for the boom cylinder do not cover the side of the swing bracket 30, an outward appearance around the swing bracket is extremely good.

Moreover, the lengths of hose 35 for the boom cylinder are configured to pass through only a part of the interior of the swing bracket 30. Therefore, the swing bracket 30 dispense with exclusive ribs and holes for piping passage as in the conventional art, so that a simple construction suffices and large-sizing thereof can be avoided, thus making the cost therefor inexpensive.

In addition, the piping group 10 for the arm cylinder 32A, the bucket cylinder 33A, and attachments except the lengths of hose 35 for the boom cylinder extend below the swing pin 22 to pass through the interior of the swing bracket 30 between the connection of the swing bracket 30 and the boom cylinder support pin 31B and are then arranged on the upper surface of the boom 31.

More specifically, the piping group 10 extends below the swing pin 22 to pass through a space surrounded by the boom cylinder support pin 31B and inner walls of the swing bracket 30 to rise to be gently bent toward the boom support pin 31C. The piping group 10 then passes through a space surrounded by the boom support pin 31C (substantially, a base end of the boom 31) and the boom mount 30C of the swing bracket 30 and is then conducted onto the upper surface of the boom 31 in an appropriate bending radius (for example, sag), which enables the piping group to perform a bending operation without hindrance even when the boom 31 swings vertically.

Accordingly, the piping group 10 rises from the main control valves 8 on the swivel frame 2 and is conducted substantially linearly below the swing pin support 21 through the piping hole 24 on the upright portion 23, so that its length suffices to amount to that of short piping (for example, preferably straight piping). Accordingly, a space occupied by the piping group is reduced, and the apparatus can be made compact to achieve reduction in cost.

In addition, according to the first embodiment, the lengths of hose 35 for the boom cylinder extend from the piping hole 34 for the boom cylinder, which is provided on the left side (as viewed from the driver seat 7) of the swing bracket 30, and are connected to the piping ports 31D provided on the left side of the boom cylinder 31A. However, the invention is not limited to such piping path but there is caused no problem even when the piping ports of the boom cylinder 31A are provided on the right side of the boom cylinder, the piping hole for the boom cylinder is provided on the right side of the swing bracket 30, and the lengths of hose 35 for the boom cylinder communicate between the piping ports and the piping hole for the boom cylinder.

Figure 5:
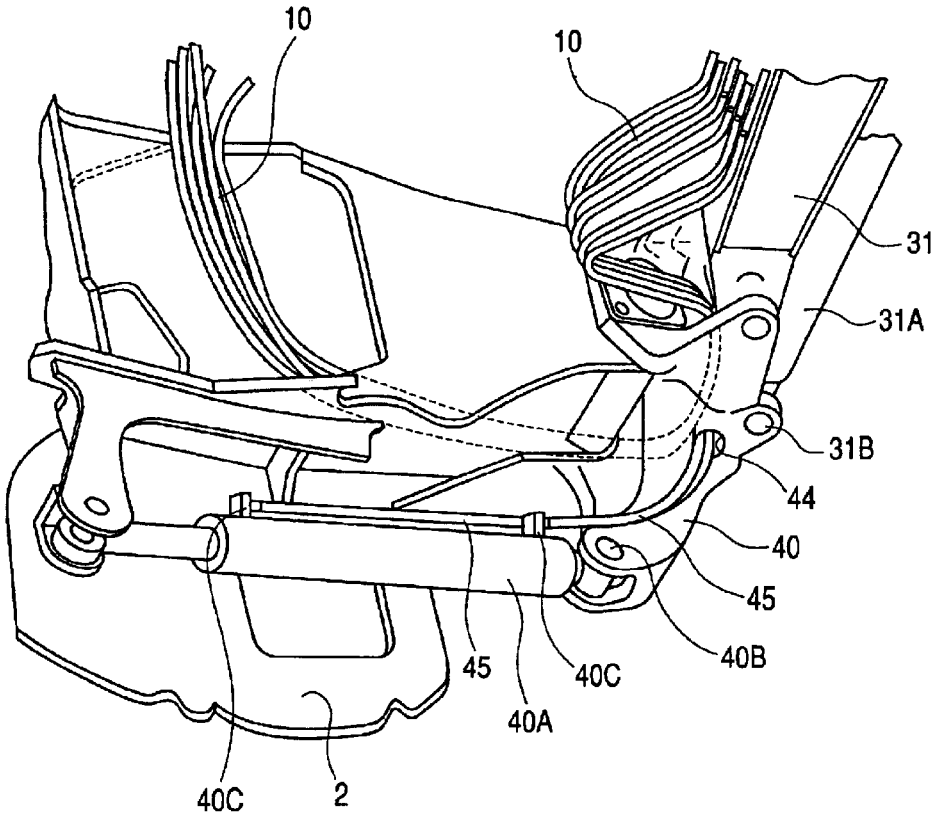
FIG. 5 is a schematic view, as viewed from rearwardly upward, of a piping arrangement for lengths of hose for a swing cylinder according to a second embodiment.
Figure 6:
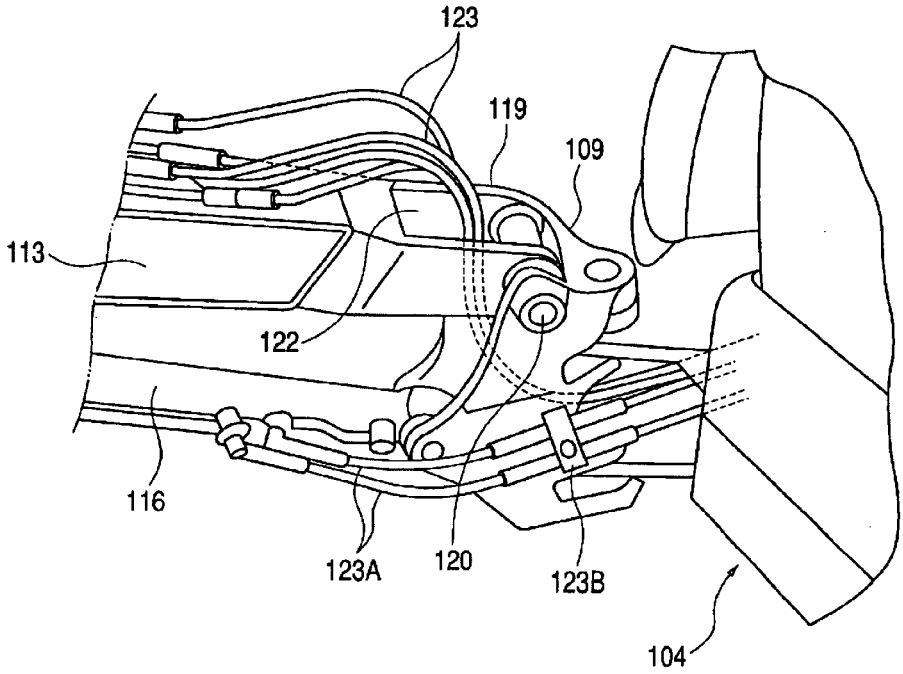
FIG. 6 PRIOR ART
FIG. 6 is a perspective view showing piping for a boom cylinder according to a first prior art.
Figure 7:
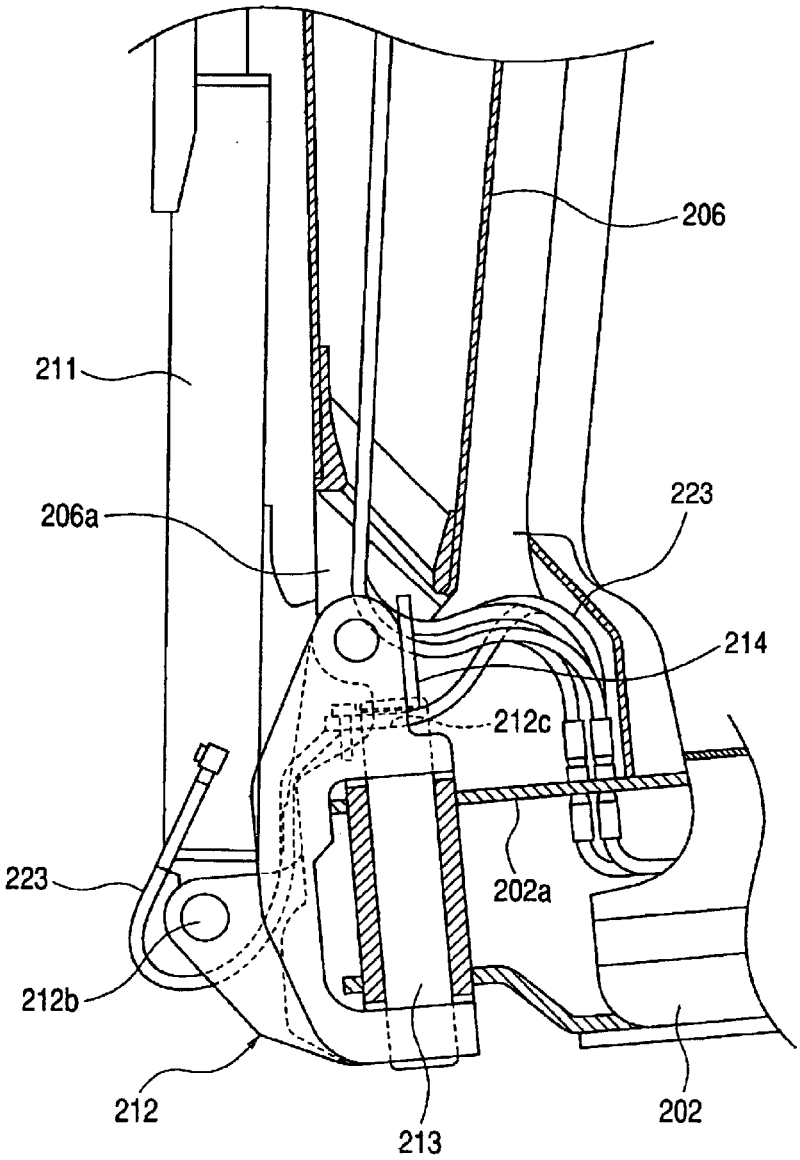
FIG. 7 PRIOR ART
FIG. 7 is a side view showing a piping for an implement according to a second prior art.

Subsequently, an exemplary piping arrangement of lengths of hose 45 for the swing cylinder according to a second embodiment will be described with reference to FIG. 5. First, the piping arrangement of lengths of hose for the swing cylinder will be described. A hole 44 for the swing cylinder, which is communicated to outside from an interior of a swing bracket 40, is formed on a right side (as viewed from the driver seat) of the swing bracket 40 to be disposed below and in the vicinity of the boom cylinder support pin 31B. Also, a swing cylinder 40A has its head-side end pivotally mounted to the swing bracket 40 through a swing cylinder support pin 40B and its rod-side end pivotally mounted to the swivel frame 2. Two lengths of hose 45 for the swing cylinder extending from the piping hole 44 for the swing cylinder are connected to respective piping ports 40C of the swing cylinder 40A. The construction except the construction described above is the same as that in the first embodiment, and so details thereof are omitted.

Subsequently, an operation of the piping arrangement according to the second embodiment will be described. Like the first embodiment (as shown in FIGS. 2 and 3), the piping group 10 (the hose group) from the main control valves 8 provided on the swivel frame 2 passes extremely smoothly through the piping hole 24, which is formed on the upright portion 23 of the swivel frame 2, in a very large radius of curvature and therefore in a substantially straight state to be arranged below the swing pin 22, that is, below the swing bracket 30. Further, the lengths of hose 45 for the swing cylinder among the piping group 10 enter into the swing bracket 40 from below and in the vicinity of the swing pin 22 to rise. Thereafter, the lengths of hose for the swing cylinder pass smoothly through the hole 44 for the swing cylinder, which is formed on the right side of the swing bracket 40 and in the vicinity of the boom cylinder support pin 31B, without being subjected to excessive bending, and are conducted outside the swing bracket 40 to be further connected to the respective piping ports 40C of the swing cylinder 40A.

In addition, the function and effect of the second embodiment are the same in contents as the first embodiment except the piping arrangement described above when the swing bracket 30, the boom cylinder 31A, the piping hole 34 for the boom cylinder, and the lengths of hose 35 for the boom cylinder in the first embodiment are replaced by the swing bracket 40, the swing cylinder 40A, the piping hole 44 for the swing cylinder, the lengths of hose 45 for the swing cylinder, respectively. Accordingly, details of the function and effect are omitted here.

In addition, according to the second embodiment, the lengths of hose 45 for the swing cylinder extend from the hole 44 for the swing cylinder, which is formed on the right side of the swing bracket 40, to be connected to piping ports 40C of the swing cylinder 40A. However, the invention is not limited to such piping path but it is a matter of course that the swing cylinder may be provided on the left side of the swivel frame 2, the piping hole 44 for the swing cylinder may be provided on the left side of the swing bracket, and the lengths of hose 45 for the swing cylinder may communicate between the swing cylinder and the piping hole 44 for the swing cylinder. Also, when the hole for the swing cylinder serves also as a piping hole for the boom cylinder, or these holes are individually provided on either of left and right sides of the swing bracket, the same function and the same effect as those described above are produced.

According to the invention, the following peculiar effect is produced. The construction of a piping hole for a cylinder, which is formed on the side of the swing bracket, makes it possible for lengths of piping hose to be connected to an implement such as a boom cylinder, a swing cylinder, and the like to pass through the piping hole from the interior of the swing bracket in a large radius of curvature and involving less bent locations without strain and to be arranged outside the swing bracket. Also, since the piping hole functions as a junction for piping and a location of constraint, it is possible to achieve shortening of piping length and optimization of piping.

Also, lengths of hose to these cylinders for an implement can be connected substantially linearly to respective piping ports of cylinders for an implement in a shortest distance and made small in length. As described above, since the lengths of piping hose can assume a large bending curvature and be reduced in bending locations and in piping length, it is possible to reduce pressure loss in piping and enhance the hydraulic drive efficiency. Besides, since there are no locations, in which excessive bending operations are performed, it is possible to extend the life of the lengths of hose. In particular, since lengths of hose for a boom cylinder are substantially restrained by the piping hole, which is positioned in the vicinity of the boom cylinder support pin constituting a center of swinging of the boom cylinder, the boom cylinder can swing about the piping hole substantially as a center at the operation thereof and perform bending operations free from expansion, sag, or the like of the lengths of hose.

Also, the lengths of hose for the boom cylinder are less in those portions, which are exposed to outside such as forward and downward, laterally, and the like, and so there is involved little fear of damage caused by fly stone and impinging matters. Further, since no hose covers a side of the swing bracket, an outward appearance of the piping arrangement around the bracket is extremely good.

What is claimed is:

1. A piping arrangement for swing type hydraulic excavators, wherein a swing bracket is provided on a forward end of a swivel frame to be able to swing horizontally, the swing bracket i) mounts thereto a base end of a vertically swingable boom by means of a first horizontal support pin, ii) mounts thereto one end of a boom cylinder, which drives the boom, by means of a second horizontal support pin, and iii) mounts thereto one end of a swing cylinder, which drives swinging of the swing bracket, by means of a vertical support pin, piping is provided on a cylinder for an implement from a side of the swivel frame through the swing bracket to be arranged, the swing bracket is formed on a side thereof with a piping hole, which extends outside from an interior thereof, and piping for the cylinder for the implement, which is disposed in the vicinity of the swing bracket, is performed from the interior of the swing bracket through the piping hole.

2. The piping arrangement according to claim 1, wherein the cylinder for the implement is the boom cylinder.

3. The piping arrangement according to claim 1, wherein the cylinder for the implement is the swing cylinder.

* * * * *